United States Patent [19]

Heiliger

[11] Patent Number: 4,820,085

[45] Date of Patent: Apr. 11, 1989

[54] ARTICULATING STEEL CAP FOR UNDERGROUND MINING SUPPORT STRUCTURES

[76] Inventor: Martha-Catharina Heiliger, Hochkoppel 11, 5160 Kreuzau, Fed. Rep. of Germany

[21] Appl. No.: 126,591

[22] Filed: Nov. 30, 1987

[30] Foreign Application Priority Data

Dec. 1, 1986 [DE] Fed. Rep. of Germany ..... 8632139

[51] Int. Cl.[4] ..... E21D 17/00

[52] U.S. Cl. ..... 405/288; 403/370; 248/357; 405/303

[58] Field of Search ..... 405/288, 291, 303, 292–296; 403/369, 370; 248/357

[56] References Cited

U.S. PATENT DOCUMENTS 2,056,248 10/1936 Buchanan ..... 403/369 X
3,991,577 11/1976 Thevenoux ..... 405/291

FOREIGN PATENT DOCUMENTS 508922 2/1952 Belgium ..... 405/288
829288 1/1952 Fed. Rep. of Germany ..... 405/288
8305874 10/1983 Fed. Rep. of Germany ..... 405/288
1015257 7/1952 France ..... 405/288

*Primary Examiner*—Dennis L. Taylor
*Attorney, Agent, or Firm*—W. G. Fasse; D. H. Kane, Jr.

[57] ABSTRACT

A steel cap for steel sets in mining support structures is made of a hollow sectional profile having a certain length. A tip is arranged as an insert at one end of the sectional profile. A fork is arranged as an insert at the other end of the sectional profile. Each insert is formed as a plug-in connection. The plug-in connection is provided with a hold free of play in a correct position. For this purpose each insert has at its end facing the sectional profile, a plug with a cross-section corresponding to that of the sectional profile, and at least one surface inclined relative to the longitudinal axis of the steel cap. At least one movable wedge element is arranged for cooperation with each inclined surface. A wedge drive permits driving the wedge element or elements into or out of a locking position relative to the respective inclined surface.

7 Claims, 2 Drawing Sheets

1
2
3
4
5
6
7
8
9
10
11
12
13
14
15
16
17
18
19
20
23
24
25
27
28
28'
29
IV
V
VI
A

ARTICULATING STEEL CAP FOR UNDERGROUND MINING SUPPORT STRUCTURES

FIELD OF THE INVENTION

The invention relates to an articulating steel cap for underground mining support structures made of a section of a hollow sectional profile of given length. A tip is inserted into one end of the hollow section. A fork is inserted into the other end of the hollow section. The tip and fork each have an insert, whereby the connection of each insert to the hollow section is constructed as a plug-in connection.

DESCRIPTION OF THE PRIOR ART

Such an articulating steel cap is already known from German Utility Model Number 83 05 874. Steel caps of this type can be manufactured at reasonable costs and the maintenance and repair can be performed efficiently. The cap components can be assembled easily on location in a mine. However, the manufacturing methods for making such a cap must meet relatively high requirements, for example, tolerance requirements. Yet, it is not possible, at reasonable costs, to insert the respective tip or fork into the hollow section completely without ply so that on the one hand so-called fretting corrosion may occur while on the other hand an undesirable edge pressure can occur.

OBJECTS OF THE INVENTION

In view of the foregoing it is the object of the invention to further develop an aritculating steel cap of the above type in such a way, that the inserts are provided with a play-free safe hold in a correct position without losing the described advantages and to avoid fretting corrosion and edge pressures.

SUMMARY OF THE INVENTION

According to the invention this object has been achieved by an insert having at its end facing toward the hollow section a profiled plug having a cross-section corresponding to the cross-section of the hollow section. Each profiled plug has at least one longitudinally inclined surface. A movable wedge element is arranged for cooperation with each longitudinally inclined surface. The wedge element is constructed to be pulled into the hollow sectional profile between the longitudinally inclined surface and an inner surface of the hollow section. Due to the use of inclined surfaces in combination with wedge elements it is possible to assure an absolutely safe hold of the respective insert with its plug in a correct position in the hollow section. An especially good hold is achieved if not only one inclined surface, but rather two corresponding surfaces arranged opposite each other are used in combination with two wedge elements. Advantageously such surfaces both have the same inclination, whereby, in combination with the corresponding wedges, the respective insert is centered in the hollow section. The connection is thus very safe, yet simultaneously easily releasable. The assembly advantages mentioned above are retained. The efficiency in the repair and maintenance known from the above described prior art, is also maintained. The connection is no longer sensitive to fretting. The undesirable edge pressing and the erroneous positioning of the respective insert caused by the edge pressing are avoided.

According to an embodiment of the invention at least one pull-anchor extending in the longitudinal direction is arranged inside the insert. The pull-anchor reaches behind each movable wedge element by means of a back-grip. The pull-anchor is constructed for external activation. Such a structure is very simple and provides external access to the pull-anchor for driving the wedges with the required force into a locking position, or to loosen the wedges.

Preferably, the pull-anchor is constructed as a threaded bolt having a bolt head accessible from the outside and a threaded portion carrying a nut forming said back-grip which is guided for axial movement in the hollow section, but held against rotation. The threaded bolt is easily operable thorough its outwardly freely accessible bolt head. The bolt threading, cooperating with the nut functioning as a back-grip, provides a very large force translation or mechanical advantage so that if necessary the wedges may be pulled in with a very large force. There is a direct force transmission between the wedge and the insert through the pull-anchor. Hence, any undesired displacement of the wedge element due to tensioning or clamping forces caused by the clamping operation, is not to be expected.

The nut of the pull-anchor has an outer cross-sectional configuration adapted, with play, to the inner cross-section of the hollow section. The nut cross-section is preferably rectangular, or approximately rectangular, or it may have a quadrangle form. If the outer cross-sectional shape of the nut corresponds, with play, to the inner cross-section of the hollow section, the nut can on the one hand not rotate, but on the other hand it can move axially without any hindrance for operating the wedge element or elements.

According to the invention, each wedge element is connected to the back-grip or nut so that the wedge element can move radially relative to the back-grip or nut without being able to move axially without axial movement of the nut. This feature has the advantage that through the pull-anchor, which is, for example, constructed as a threaded bolt, the wedge element or elements can be simply driven out of their clamping position, from the outside, for loosening the connection between the hollow section and the insert. For this purpose the threaded bolt is pressed or punched inwardly in an axial direction to thereby take along the nut which in turn entrains the wedge element or elements axially thereby loosening the connection.

The invention also provides that the insert constructed as a fork, is longitudinally divided centrally in a plane parallel to the fork surfaces. A longitudinal division of the fork is possible without losing the securing strength or safety of the fork. Dividing the fork provides simultaneously a more cost efficient production and repair of such a fork because in case of damage only one half of the fork is damaged while the other half remains usable. Thus, it is possible in case of damage to exchange but one half of the fork. As result, the stock maintenance is substantially reduced anD a smaller weight needs to be transported when repairs are necessary. If the fork is divided, it is possible to provide a separate wedge for each inclined surface of the profiled plug of the fork half. Due to this feature possibly the smallest dimensional tolerances between the inclined surfaces of the two cooperating fork halves may be compensated. This division of the wedges to be used is within the scope of the invention. It is also possible to incline all plane surfaces of the profiled plugs of the divided fork as well as of the undivided fork and of the tip and to allocate wedges to these inclined surfaces. Thus, a very rigid fixation can be achieved in all directions. However, especially the inclined surfaces of the profiled plugs which apply the main force to the respective wedge and thus transmit this force to the hollow section should be covered as much as possible by the wedges for reducing surface pressure during the force transmission.

According to the invention the angle of inclination of the inclined surfaces is within the range of 2° to 10°, whereby a very strong connection is achieved even with relatively small pulling-in forces.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figures 1, 2:
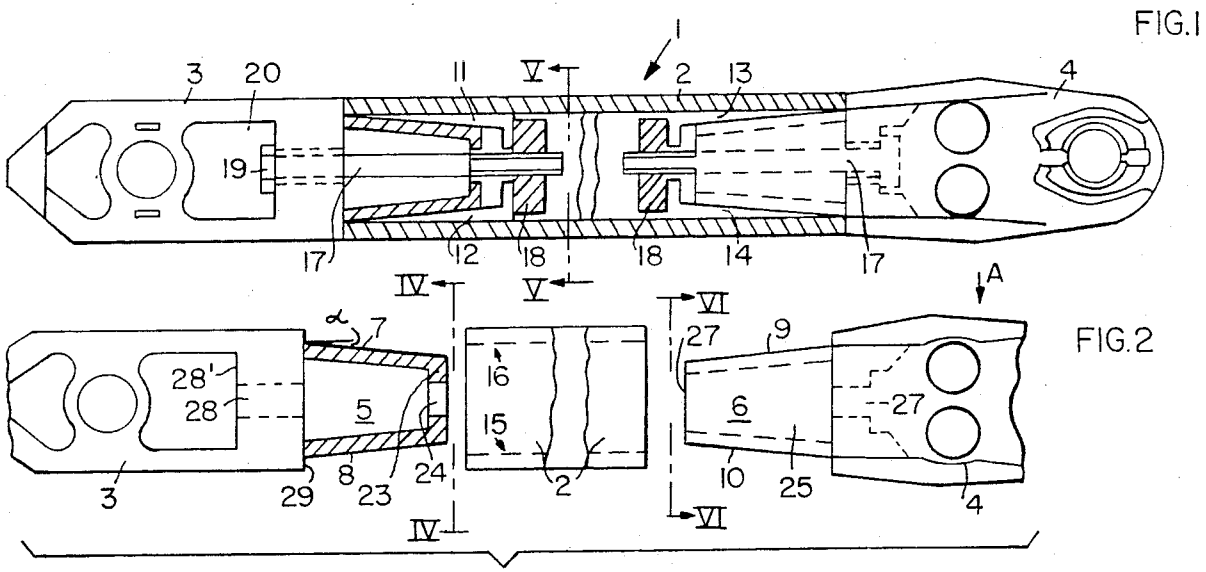
FIG. 1 is a longitudinal section through a cap of the invention including a hollow steel section, a tip inserted into one hollow end and a fork inserted into the other hollow end of the steel section.
FIG. 2 shows the present cap of FIG. 1 with the tip and cap pulled out.

FIG. 1 shows a side view, partially in section, of an articulating steel cap 1. The central member 2 of the cap 1 is constructed as an integral box profile or section that may be cut from a length of hollow sectional steel. A tip 3 is provided at one end of the hollow box section 2 and a fork 4 is provided at the other end of the hollow box section 2. The tip 3 has a profiled insert plug 5. The fork has a profiled insert plug 6. In the illustrated arrangement, the line of effectiveness of the main load direction is located in the plane of the drawing or parallel thereto. The profiled insert plug 5 of the tip comprises, perpendicularly to the plane of the drawing, and in an opposed arrangement, two surfaces 7 and 8 inclined in the longitudinal direction so as to converge inwardly relative to the hollow box section 2. Each of these surfaces 7 and 8 has an angle of inclination alpha in the range of about 2° to 10°. The plug 5 may have additional wall members or lateral surfaces extending parallel to the plane of the drawing. These additional wall members or lateral surfaces have such a spacing from one another, that they fit with as little play as possible into the respective hollow space of the hollow box section 2. Such a surface arrangement is known from the above described prior art. The additional wall members are not absolutely necessary, however, they may be advantageous since they may contribute substantially to the stiffness of the entire system. It is also conceivable that these additional wall members have a corresponding inclination as, for example, the longitudinally inclined surfaces 7 and 8. The facing ends of at least the longitudinally inclined surfaces 7 and 8 may bear mutually against a wall member or bottom 23 having an opening 24. The walls having the surfaces 7, 8 and the bottom 23 preferably form an integral plug. These wall members forming the longitudinally inclined surfaces 7 and 8 must be sufficiently supported relative to each other.

Figure 6:
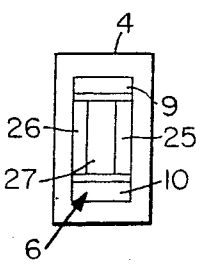
FIG. 6 is a section along section line VI—VI in FIG. 2.
Figure 5:
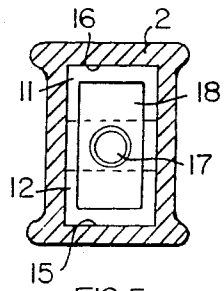
FIG. 5 is a section along section line V—V in FIG. 1.
Figure 4:
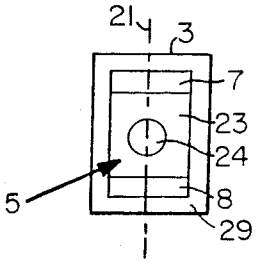
FIG. 4 is a section along section line IV—IV in FIG. 2.

The profiled insert plug 6 of the fork 4 is constructed substantially similarly as the plug 5 with longitudinally inclined surfaces 9 and 10. The longitudinally inclined surfaces 9 and 10 also have the inclination angle alpha of about 2° to 10° and they converge inwardly into the hollow box section 2. The plug 6, however, shows a modification of an example embodiment. Namely, the longitudinally inclined surfaces 9 and 10 are supported exclusively by the wall members 25 and 26 so that at the facing side or end a natural opening 27 remains. The respective cross-sectional shapes of the hollow box section 2 and of the inserts 3 and 4 are shown in FIGS. 4 to 6. FIG. 4 is a view onto the plug 5 of the tip 3 prior to inserting the plug 5 into the hollow box setion 2. FIG. 5 shows the tip 3 inserted with its plug 5 into the box section 2 whereby the nut 18 and the threaded end of the pull-anchor 17 are visible. FIG. 6 shows a view onto the plug 6 of the fork 4 prior to inserting the plug 6 into the box section 2.

Figure 3:
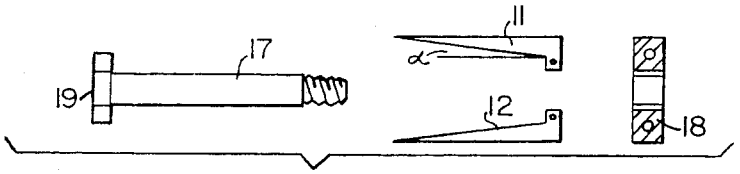
FIG. 3 is an exploded side view of the pull-anchor, the wedge elements, and the back-grip member or nut.

For securing the inserts 3 and 4, for example, the threaded bolt 17 forming a pull-anchor is inserted in the longitudinal direction into the insert 3. For this purpose the threaded bolt 17 is passed through the opening 28 and through the opening 24 until the bolt head 19 comes to rest on the shoulder 28'. The nut 18 is now screwed onto the threaded part of the threaded bolt 17. The nut 18 is left in a rotated position which permits the insertion of the nut 18 into the hollow box section 2. The cross-section of the nut 18 corresponds, with sufficient play, to the inner cross-section of the hollow box section 2 so that the nut 18 inserted into the box section 2 cannot rotate any more. Two movable wedge elements 11 and 12 placed to rest with their inclined surfaces on the respective inclined surfaces 7 and 8 of the profiled insert plug 5, bear axially against the nut 18. The wedge elements are connected with the nut 18 in any desired manner in such a way that they can at least move slightly radially. An axial movement of the nut 18 in both directions shall entrain the movable wedge elements 11 and 12 so that these wedge elements 11 and 12 may be locked or loosened. The sequence of assembly of the pull-anchor device, however, without the insert tip 3, is shown in an exploded view in FIG. 3.

When the device is assembled, the insert tip 3 may be pushed with its profiled insert plug 5 axially into the hollow box section 2 until the facing end 29 of the insert 3 bears against the respective facing edge of the hollow box section 2. When this condition is achieved, the bolt head 19 of the threaded bolt 17 acting as a pull-anchor, is rotated. Since the nut 18 cannot rotate inside the hollow box section 2, it travels in the axial direction toward the bolt head 19, thereby pushing the movable wedge elements 11 and 12 in the axial direction so that the wedge gap between the inclined surfaces 7 and 8 of the profiled insert plug 5 on the one hand and the respective inner surfaces of the hollow box section 2 on the other hand is completely filled, whereby the wedge elements are in a locking position. The movable wedge elements 11 and 12 can thus be pulled with a very large force into the wedge gap, whereby an extraordinarily strong connection is established, which simultaneously centers the insert tip 3 in the correct position in the box section 2. Preferably, the width of the movable wedge elements 11 and 12 is so dimensioned that they cover the respective width of the longitudinally inclined surfaces 7 and 8 as much as possible in order to achieve a surface pressure as small as possible in spite of high clamping forces. The same applies naturally to the movable wedge elements 13 and 14 in their arrangement and relationship to the longitudinally inclined surfaces 9 and 10 of the profiled insert plug 6. The wedge elements 13, 14 are assembled and used in the same manner as described above with reference to the profiled insert plug 5.

Figure 7:
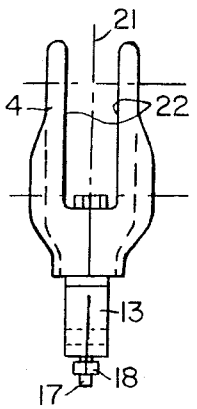
FIG. 7 is a view in the direction of the arrow A in FIG. 2 rotated to the left by 90°.

The described manner of attaching the insert tip 3 and insert fork 4 according to the invention in the hollow box section 2 for forming an articulating steel cap 1, makes it advantageously possible to divide the fork 4 in the plane 21 parallel to the fork surfaces 22. The dividing plane 21 is indicated in FIGS. 4 and 7. The division of the fork 4 on the one hand has the advantage that the respective individually forged half fork sections are simpler and hence more cost efficiently produceable so that the fork 4 assembled of these half fork sections is cheaper than forks which are produced as integral members by conventional methods. On the other hand, such as divided fork 4 can be repaired more efficiently than heretofore because in case of damage normally only one half of a fork 4 is damaged. If the fork 4 is a single integral piece, the entire fork becomes useless and must be replaced. However, in the case of a divided fork, only the damaged half becomes useless and can be replaced by a respectively less expensive new half fork. Since half of the fork is naturally also substantially lighter than an entire fork, the repair work is respectively simplified. Further, the stock supplies may be reduced by this feature, especially the stock supplies directly in the mine. In the case of the divided fork it may be advantageous to also divide the longitudinally movable wedge elements 13 and 14 in the longitudinal direction so that also small differences in the inclination of the longitudinally inclined surfaces 9 and 10 may be compensated. These inclined surfaces 9 and 10 are now allocated each to its fork half. However, when the longitudinally inclined surfaces 9 and 10 are corresponding to each other with a sufficient precision, such feature is not necessary.

Due to the pull-in, the outer not inclined surfaces of the movable wedge elements 11 to 14 come to rest rigidly against the inner surfaces 15 or 16 of the hollow box section 2 so that in the axial direction a very strong force-locking or clamping is produced while in the radial direction a form-locking connection with the hollow profile section 2 is provided. With this type of connection the advantages of an articulating steel cap having a welded-on tip and fork, are achieved without the serious disadvantages. Rather, according to the invention it is possible to combine the advantages of the known welded steel cap with the advantages of the known plug-in steel cap and simultaneously eliminate the disadvantages of both systems. Additionally, the invention has the following advantages. It provides th possibility of selecting the material for making the cap. It reduces the stock maintenance and thus assures smaller stock maintenance costs than in the prior art. The tools needed for assembling the present caps are simple and relatively coarse tools readily available in a mine. Additionally, the present caps have a smaller weight than heretofore. These features, for the first time, make it possible to use the present caps in developing countries where mining operations take place. The caps are especially advantageous for these countries because heretofore the mining support structures were mainly made of wooden timbers in these countries with the result that forests become denuded with dangerous ecologic consequences. Additionally, in the long run the present steel caps are more economical than the conventional wooden timber support structures.

Although the invention has been described with reference to specific example embodiments it will be appreciated, that it is intended to cover all modifications and equivalents within the scope of the appended claims.

What I claim is:

1. An articulating steel cap for mining support structures, comprising a hollow box section having a given inner cross-sectional shape, a cap tip at one end of said hollow box section, a cap fork at the other end of said hollow box section, plug-in connection means for securing said cap tip and said cap fork to said hollow box section, said plug-in connection means comprising a profiled plug (5, 6) rigidly connected to said cap tip and to said cap fork, each profiled plug having a cross-section corresponding to said given inner cross-sectional shape of said hollow box section, each profiled plug having wall members with at least one longitudinally inclined surface (7–10), a movable wedge element (11–14) arranged for cooperation with the respective longitudinally inclined surface, and means for pulling each wedge element into a space between said longitudinally inclined surface (7–10) and an inner surface (15, 16) of said hollow box section for wedging said profiled plugs into a locking position and for also moving said plugs into a release position.

2. The articulating steel cap of claim 1, wherein said pulling means comprise a pull-anchor (17) arranged to extend longitudinally through its respective cap tip and profiled plug and its respective cap fork and profiled plug, said pull-anchor having a back-grip (18) reaching behind each movable wedge element (11–14), said cap tip and cap fork having access holes for an external operation of said pull-anchors.

3. The articulating steel cap of claim 2, wherein said pull-anchor comprises a threaded bolt (17) having an externally accessible bolt head (19) and a threaded portion, a nut (18) on said threaded portion, said nut forming said back-grip which is guided for axial movement inside said given inner cross-sectional shape of said hollow box section, but prevented from rotating inside said hollow box section.

4. The articulating steel cap of claim 3, wherein said nut (18) has an outer cross-sectional shape adapted to said given inner cross-sectional shape of said hollow box section.

5. The articulating steel cap of claim 2, wherein each wedge element (11–14) is connected to said back-grip (18) for radial movement relative to said back-grip and for axial movement only with said back-grip (18).

6. The articulating steel cap of claim 1, wherein said cap fork (4) is centrally divided longitudinally in a plane (21) parallel to fork surfaces (22).

7. The articulating steel cap of claim 1, wherein said inclined surfaces (7–10) have an angle of inclination within the range of about 2° to about 10°.

* * * * *